US006436232B1

(12) United States Patent
Silenius et al.

(10) Patent No.: US 6,436,232 B1
(45) Date of Patent: Aug. 20, 2002

(54) PROCEDURE FOR ADDING A FILLER INTO A PULP BASED ON CELLULOSE FIBERS

(75) Inventors: Petri Silenius, Kirkniemi; Markku Leskelä, Lohja; Johan Gullichsen, Hirsijärvi; Esa Halinen, Helsinki, all of (FI)

(73) Assignee: M-Real Oyj., Espoo (FI)

( * ) Notice: Subject to any disclaimer, the term of this patent is extended or adjusted under 35 U.S.C. 154(b) by 0 days.

(21) Appl. No.: 08/804,181

(22) Filed: Feb. 20, 1997

(30) Foreign Application Priority Data

Feb. 20, 1996 (FI) ..... 960774

(51) Int. Cl.[7] ..... D21H 17/70; D21H 17/67; D21H 17/63

(52) U.S. Cl. ..... 162/9; 162/181.2; 162/181.4; 162/182; 162/183

(58) Field of Search ..... 162/9, 181.2, 181.4, 162/181.8, 182, 56, 183, 185

(56) References Cited

U.S. PATENT DOCUMENTS

| | | | | |
|---|---|---|---|---|
| 2,583,548 A | | 1/1952 | Craig | 106/204 |
| 3,029,181 A | | 4/1962 | Thomsen | 162/181 |
| 5,223,090 A | * | 6/1993 | Klungness | 162/9 |
| RE35,460 E | | 2/1997 | Klungness et al. | 162/9 |
| 5,690,786 A | * | 11/1997 | Cirucci et al. | 162/6 |

FOREIGN PATENT DOCUMENTS

| | | | |
|---|---|---|---|
| FI | 68688 | * | 6/1978 |
| FI | 68688 | | 6/1985 |
| FI | 933789 | | 12/1991 |
| JP | 62162098 | * | 12/1985 |
| JP | 6264394 | | 3/1993 |
| JP | 6264394 | * | 6/1993 |

OTHER PUBLICATIONS

Gullichsen & Harkonen "Medium Consistency Technology", Tappi, Jun. 1981, vol. 64, No. 6, pp. 69–72.
Bennington, Kerekes and Grace "Motion of Pulp Fibre Suspensions in Rotary Devices", The Canadian Journal of Chemical Engineering, vol. 69, Feb. 1991, pp. 251–258.
Tuomisaari, Gullichsen and Hietaniemi "Floc Disruption in Medium–Consistency Fiber Suspensions", 1991 International Ppaer Physics Conference, pp. 609–612.
Chen Ke–fu and Chen Shu–mei "The Determination of the Critical Shear Stress for Fluidization of Medium Consistency Suspensions of Straw Pulps" Nordic Pulp and Paper Research Journal No. Jan. 1991, pp. 20–22, 42.
Seth, Francis and Bennington "The Effect of Mechanical Treatment During Medium Stock Concentration Fluidization on Pulp Properties" Appita vol. 46, No. 1, pp. 54–58, 60.

* cited by examiner

*Primary Examiner*—Dean T. Nguyen
(74) *Attorney, Agent, or Firm*—Altera Law Group, LLC

(57) ABSTRACT

The invention relates to a procedure for adding a filler into a pulp based on cellulose fibers, in which the pulp is fluidized and the filler is added into it. Preferably the pulp is stirred in the fluidized state while the filler is being added. The pulp is preferably at a medium consistency when the filler is being added. Preferably the filler added into the pulp is calcium hydroxide and the calcium carbonate is precipitated with carbon dioxide.

11 Claims, 6 Drawing Sheets

PROCEDURE FOR ADDING A FILLER INTO A PULP BASED ON CELLULOSE FIBERS

FIELD OF THE INVENTION

The present invention relates to a procedure for adding a filler into a pulp based on cellulose fibres, as defined in the preamble of claim 1.

"Pulp based on cellulose fibres" in this context refers to pulps used in paper and pulp industry, produced by chemical or mechanical methods from plants or plant parts containing lignocellulose, such as wood or plants with a herbaceous stalk, from which the lignin has been removed or in which the lignin is partly or completely preserved, such as cellulose, wood pulp, refiner mechanical pulp, mixtures of these, fine material originating from these and/or derivatives of these. "Paper" refers to different kinds of paper and cardboard, coated or uncoated, produced with a paper and cardboard machine.

BACKGROUND OF THE INVENTION

Today, the trend of development of paper products is increasingly determined by the buyers of these products and by legislative measures. The buyers of printing paper want to economize on postage costs and reduce the amount of waste produced. Further, waste processing charges depending on weight have been imposed on packing materials. Generally, it seems that energy and disutility taxes are being added as an extra imposition to the price of paper products. For these reasons, paper buyers want paper products having a lower grammage which still meet high quality requirements.

Because of the general trend of development described above, there is a need to produce high-quality paper using a reduced amount of raw material. When the grammage of paper is reduced, its density becomes a critical property. In many applications, an even more critical property is the stiffness of paper, which is heavily reduced as the density is increased. This leads to a need to alter the structure of paper so as to reduce its density to a minimum. This imposes further requirements on the raw materials of paper and on paper production processes.

For paper-based communication to remain competitive with respect to electric communication, the impression quality of paper products should be further improved. Considering the strong tendency towards reducing the grammage of paper, gradual and slow development of different kinds of paper is not sufficient in this situation, but instead more intensive development of paper quality is necessary.

During several years, investigations have been made into the use of fillers to fill the pores and cavities in chemical pulp fibre. According to the investigations, the advantages include a better filler retention in paper manufacture, the possibility to increase the filler content of paper, reduced soiling and wear of the wire and reduced linting of paper. The use of titanium dioxide in this connection has been reported by Scallan et al. Patent specifications U.S. Pat. Nos. 22,583,548 and 3,029,181 describe methods by which calcium carbonate is precipitated in and on the fibres using two salts having a good water-solubility, e.g. calcium chloride and sodium carbonate. The method has the drawback that it produces a soluble by-product which has to be washed off before the fibres are used for paper production. This increases the amount of water needed, which is why the method is not very viable. Another drawback with these methods are the chemical changes that take place on the surface of the chemical pulp fibre, which involve a significant reduction in the strength values of the paper when such fibres are used in paper manufacture.

Specification JA 62-162098 describes a procedure in which carbon dioxide is added into a hydrous slurry of chemical pulp and calcium hydroxide, with the result that calcium carbonate is precipitated. The method has the drawback that the treatment is performed at a low consistency of chemical pulp. In this case a significant proportion of the carbonate is precipitated in the bulk solution and on the surface of the fibres instead of inside the fibres, resulting in a rather low paper strength. In addition, at a low chemical pulp consistency, the amount of water needed and also the volume of the crystallizing reactors needed on an industrial scale are high, which is uneconomic.

Today, the target is to reduce the amount of water used, the final aim being closed circulation. Because of this, the implementation of the above-described procedure at a low chemical pulp consistency is questionable.

Specification U.S. Pat. No. 5,223,090 describes a method in which the precipitation of calcium carbonate with carbon hydroxide is performed in a pressurized disc refiner in a medium-consistency chemical pulp suspension (consistency values 5–15% by weight). Paper produced by this method has better strength properties as compared with earlier filling methods. A significant drawback with this method is fast wear or refiner discs, because calcium carbonate and its raw material, calcium hydroxide, cause heavy wear. Moreover, the procedure comprises before the precipitation of the carbonate a low-consistency stage during which the calcium hydroxide is mixed with the chemical pulp. Therefore, the amount of water needed is in fact not at all smaller than in earlier methods, which limits the applicability of the method in production.

Precipitation of calcium carbonate with carbon dioxide at a high chemical pulp consistency has been subject to certain limitations due to the fact that if the consistency exceeds 2%, effective mixing of chemical pulp suspensions becomes more complex and more difficult. This is because the cellulose fibres in the water tend to form floccules in which fibres are hitched together. This phenomenon has been widely investigated since the 1950s, and it has been established that flocculation is a mechanical effect which always occurs when the fibre consistency in the suspension exceeds a critical value. For pulp fibres, this limit consistency is very low, below 0.1%.

SUMMARY OF THE INVENTION

The object of the present invention is to eliminate the drawbacks described above. A specific object of the invention is to present a new procedure for adding a filler to a pulp based on cellulose fibres so that the addition can be performed in a controlled manner in a medium-consistency suspension.

A further object of the invention is to present a new procedure for adding a filler to a pulp based on cellulose fibres so that a better filler retention is achieved and the filling agents are not washed away with the water during the paper production process. A further object of the invention is to present a new procedure for adding a filler to a pulp based on cellulose fibres so that the flexural strength of paper manufactured from the pulp is higher than when commercial fillers are used. A further object of the invention is to eliminate problems in the handling of the process water that are caused by fillers washed away with the water from the process. A specific object of the invention is to present a procedure for adding a filler into a pulp so that the procedure allows the use of a higher filler content in the paper than before so that a good retention is also achieved.

As for the features characteristic of the invention, reference is made to the claims.

The invention is based on comprehensive investigations. During the investigations it was established that the tendency of a fibre suspension to flocculate depends on many factors, but the most important factor is the consistency of the suspension. In medium-consistency fibre suspensions, the fibres are normally heavily flocculated. Flocculation can be reduced by influencing the state of flux of the suspension. It was found in the investigations that in a sufficiently intensive state of flux the suspension behaves like a Newtonian fluid in a turbulent state. The transition into such flux is hereinafter referred to as fluidization of a suspension.

The power required for fluidization is generally below 5 kW/l and it is indicated by the torque and the speed of rotation of the rotor together. In earlier investigations by Gullichsen et al it has been established that pulp consistency has an effect on the torque required for fluidization, but in a fluidized state there are not differences between pulps having different consistencies. However, for medium-consistency pulps, the torque needed to maintain flux even in the fluidized state is somewhat higher than for water.

Methods for bringing a fibre suspension into the fluidized state and in general the fluidization of a fibre suspension are described in the following publications: J. Gullichsen and E. Härkönen, Medium Consistency Technology I. Fundamental Data, Tappi 64 (6), 69 (1981); C. P. J Bennington, R. J. Kerekes and J. R. Grace, Motion of Pulp Fibre Suspensions in Rotary Devices, Canadian Journal of Chemical Engineering 69, 251 (1990), M. Tuomisaari, Kuitususpensioiden reologinen käyttäytyminen, PCS Communications 19, Keskuslaboratorio (1991); M. Tuomisaari, J. Gullichsen and J. Hietaniemi, Floc Disruption in Medium-Consistency Fiber Suspensions, Proc. 1991 International Paper Physics Conference, TAPPI Press, 609 (1991); Chen Ke-fu and Chen Shu-mei, The Determination of the Critical Shear Stress for Fluidization of Medium Consistency Suspension of Straw Pulps, Nordic Pulp and Paper Research Journal 6 (1), 20 (1991) and R. S. Seth, D. W. Francis and C. P. J. Bennington, The Effect of Mechanical Treatment During Medium Stock Consentration Fluidization on Pulp Properties, Appita 46(1), 54 (1993).

The invention is based on fluidizing a pulp and adding an inorganic filler into it. The inorganic filler is thus added e.g. into a cellulose-based pulp used as a raw material of paper when the pulp is in the fluidized state or by using periodic successive fluidizations. The pulp is preferably stirred in the fluidized state when the filler is being added.

Comparing the procedure of the invention with the method described in the specification U.S. Pat. No. 5,223,090 mentioned above, let it be stated that, in the reference specification, precipitation is performed in a non-fluidized state; for example, no fluidization occurs in the refiner. In contrast, according to the present invention, precipitation is expressly performed when the chemical pulp suspension is in the fluidized state.

When the filler is being added, the consistency of the pulp based on cellulose fibres may be e.g. 0.0001–18% by weight. However, the advantages of the invention manifest themselves at higher consistencies, such as over 0.1 w-%, preferably over 2 w-% and especially in medium-consistency suspensions with a consistency >5 w-%, preferably >10 w-%, up to 15%, even 18 w-%, at which consistency levels it has never before been possible to achieve the advantages provided by the procedure of the present invention.

The procedure of the invention can be applied by performing the following treatments while the fibre suspension is in the fluidized state or using periodic successive fluidizations:

Filling the pores and/or lumina of fibres based on cellulose fibres by precipitating calcium carbonate into the pores and/or lumen in the wall of chemical pulp fibres (in-situ), Producing porous calcium carbonate aggregates by precipitating calcium carbonate (in-situ) in the presence of a cellulose-fibre based fine material, such as a fine material obtained from chemical pulp fibres, mechanical pulp or refiner mechanical pulp.

Thus, the fibre suspension can be in the fluidized state when calcium hydroxide is added and/or the precipitation of carbonate with carbon dioxide is performed and/or the suspension can be fluidized before and/or after the addition of the chemicals or before and/or after the addition of a chemical.

When the filler is calcium carbonate produced by precipitating it by the carbon dioxide method, there is generally an optimal range for the content of raw materials of calcium carbonate in the precipitation rector or crystallizer. In the optimal range, crystallization can be performed economically and in a controlled manner. If calcium carbonate is crystallized into fibre (in-situ) at a low consistency, it is not possible to get anywhere near the economical range of calcium hydroxide content, which is 7–15 w-% $Ca(OH)_2$ of the total weight of the mixture. In low-consistency crystallizers, a maximum calcium hydroxide content of about 2 w-%, and at consistencies advantageous in respect of pulp flux, only a content of 0.3 w-% of the total weight can be reached. For this reason, when operating at a low consistency level, the crystallization would have to be carried out using large low-consistency crystallizers and a large amount of water.

When the precipitation is performed in a medium-consistency mixer by the method of the invention, a calcium hydroxide content of 7.5 w-% of the total weight of the mixture is easily achieved, which is already in the economical range. By performing the precipitation at medium consistency, a calcium hydroxide content as high as 18 w-% of the total weight of the mixture can be advantageously reached.

When the procedure of the invention is applied, whereby calcium carbonate is precipitated into the pores and/or lumen of the fibre wall, the size of reactors and the amount of water required are considerably lower than when operating at a low fibre consistency.

According to the invention, for pore-filled fibres, the amount of filler contained in the pores of the fibre wall and in the lumen may be 0–30 w-%, up to 50 w-%, even 60 w-%, preferably 0–30 w-%. For lumen-filled fibres, the amount of calcium carbonate contained in the pores of the fibre wall and in the lumen may be 0–30 w-%, up to 50 w-%, even 60 w-%, preferably 0–15 w-%. Filled fibres may have a filler content of over 0 w-%, e.g. over 1 w-%, possibly over 5 w-%. In the manufacture of porous calcium carbonate aggregates, the mass ratio of $Ca(H)_2$ and fine material may be 10–2000 w-%, preferably 140–400 w-%.

The porous calcium carbonate crystal aggregate pulp produced by the method described above, obtained by precipitating calcium carbonate into the pores of the fibre wall and/or into the lumen (in-situ) and/or by precipitating calcium carbonate in the presence of a fine material based on cellulose fibres, can be dried and used after the drying or it can be used immediately as such in its wet condition in paper manufacture. Generally no washing of the fibres after the treatment is needed due to the small amount of bulk water used during precipitation, which means that less carbonate is precipitated on the fibre surfaces during pore and/or lumen filling.

In the procedure of the invention, calcium carbonate can be generally crystallized from water solutions containing ions of calcium and carbonate. In general, the reaction may be of a liquid/liquid, gas/liquid, liquid/solid or gas/liquid/solid type.

In the carbon dioxide method, the net reaction is $$Ca(OH)_2+CO_2 \Leftrightarrow CaCO_3+H_2O \quad \text{(I)}$$

Calcium carbonate is precipitated when calcium hydroxide reacts according to the reaction equation. The mineral form of the calcium carbonate and the shape and size of its crystals can be influenced by adjusting the reaction conditions. The dosage of $Ca(OH)_2$ relative to fibre weight may be 0–200 w-%, generally it is of the order of 10–30 w-%. Carbon dioxide can advantageously be dosed directly into the mixing reactor in which the fluidization is performed, preferably in a stoichiometric proportion and in a pressurized state. If desired, it is also possible to use a slight excess of carbon dioxide. The carbon dioxide can be supplied at a desired pressure, e.g. 1–20 bar, preferably 1–10 bar.

Carbon dioxide precipitation can be performed in batch mode or continuously. Mixing reactors can also be connected in parallel and/or in series. In precipitation on an industrial scale, it is possible to use a suitable number of mixers connected in parallel and in series so that the required amount of chemical pulp can be processed and a complete reaction can be achieved. Generally it is not necessary to use successive reactors or reactors connected in series, because the reaction will also advance in containers possibly provided between the mixers when the gas mixture is good.

After the precipitation, a chemical, e.g. starch, aggregating the filler can be added to the fibrous pulp, the amount of such chemical being e.g. 0.1–4 w-%, preferably 2±1 w-% of the weight of the filler.

The mixer used in the procedure of the invention for the fluidization of the fibre suspension may be any kind of mixer that is capable of producing fluidization, i.e. of bringing the fibre suspension into the fluidized state. The mixer may be e.g. a turbine-type one, in which the pulp undergoes an intensive mixing effect. The mixer may also be provided with a chemical feed device for supplying the chemical to be precipitated and the precipitating chemical into the pulp to be mixed. A suitable mixer is a mixing reactor that works at a pressure of 1–20 bar, preferably 1–10 bar and is provided with calcium hydroxide and gas feed equipment for supplying $Ca(OH)_2$ and gaseous carbon dioxide at the pressures indicated into the pulp to be mixed. The mixer may be a batch reactor or a continuous reactor.

The procedure of the invention and the pigments precipitated and/or added into the pulp, especially the calcium carbonate precipitated into the pores and lumen of the fibres, provide completely new ways of developing the critical properties of printing paper products while at the same time reducing the grammage. Especially the fact that calcium carbonate can be precipitated into the walls and lumina of fibres in a medium-consistency chemical pulp suspension is new and unexpected. Another new feature is the fact that calcium carbonate can be precipitated in the presence of a cellulose-fibre based fine material at medium consistency, Producing porous calcium carbonate crystal aggregates held together by fine material fibrils, which aggregates can be used directly as such in paper manufacture in a desired proportion to the paper pulp.

The invention makes it possible, especially when the procedure is used with medium-consistency pulps, to maintain a relatively nigh dry matter content of the pulp as compared with conventional processing at a lower consistency. Therefore, the procedure can be implemented on an industrial scale using relatively small-sized equipment, which is not possible when pulp is processed at a lower consistency.

When calcium carbonate is precipitated explicitly in medium-consistency pulp, the calcium hydroxide content of the raw material can be maintained in the optimal range, permitting a better control of the precipitation.

Furthermore, the procedure allows a significant improvement regarding the efficiency of energy use.

Moreover, the invention makes it possible to achieve a very fast reaction (formation and precipitation of $CaCO_3$) and therefore a short processing time when a pressurized mixer and, preferably gaseous, carbon dioxide are used. The carbon dioxide used in the procedure may be mainly pure or impure and it may contain other gases. It is especially advantageous to use carbon dioxide obtained from flue gases or to use flue gases as such; the carbon dioxide concentration is e.g. of the order of 15±5%.

Further, the procedure of the invention allows a very good filler retention to be achieved in paper manufacture.

Further, when pore and/or lumen filling is performed at medium consistency, less calcium carbonate is precipitated outside the fibres because the amount of bulk water is small. For this reason, the strength properties of the paper produced are better as compared with prior-art filling methods. Especially the flexural strength of the paper is higher than in corresponding paper grades in which the fillers have been added by conventional techniques.

Further, when pulp produced by the method of the invention is used for paper manufacture, the paper will have a low density, which is an advantage in a situation where a lower grammage of paper is desired.

The procedure of the invention is applicable for use in the manufacture of all kinds of paper and cardboard. However, the primary area of application is the manufacture of paper grades for office use.

BRIEF DESCRIPTION OF THE DRAWINGS

In the following, the invention is described in detail by the aid of embodiment examples by referring to the attached drawings, in which.

DETAILED DESCRIPTION OF PREFERRED EMBODIMENTS

Figure 1:
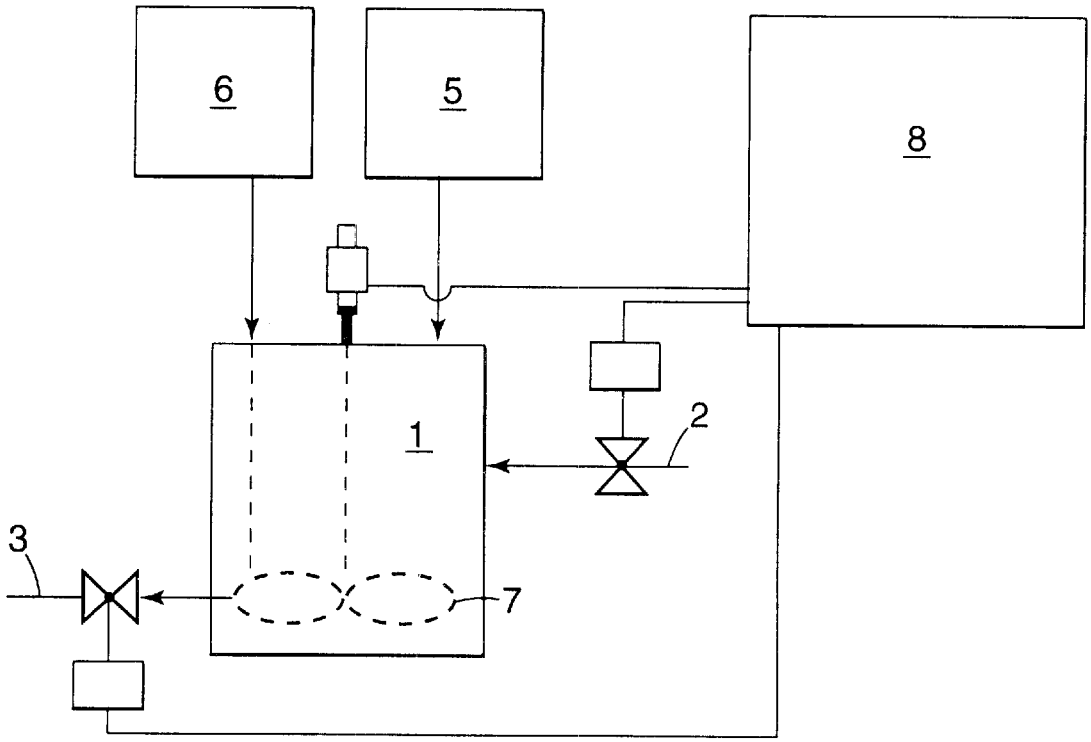
FIG. 1 presents a diagram of an apparatus according to the invention.

FIG. 1 shows a diagram representing a continuous apparatus designed for implementing the procedure of the invention. The apparatus comprises a mixing reactor 1 provided with a pulp inlet duct 2 for the supply of pulp into the reactor and with an outlet duct 3 for continuous removal of pulp from the reactor. Moreover, the reactor is provided with feed devices 5 and 6 for the supply of a calcium hydroxide mixture and a carbon dioxide gas, respectively, into the reactor. The reactor is a pressure reactor, range of operation 1–20 bar. The reactor is provided with a mixer 7 and a mixer motor. A control device 8, e.g. a computer, is arranged to control the operation of the apparatus.

When the procedure is applied, pulp based on cellulose fibres as well as calcium carbonate and carbon dioxide are supplied continuously into the reactor 1. At the same time, the pulp is stirred vigorously so that the pulp is in the fluidized state. In this situation, the calcium carbonate is precipitated into the pores and lumen of the fibres.

Figure 2:
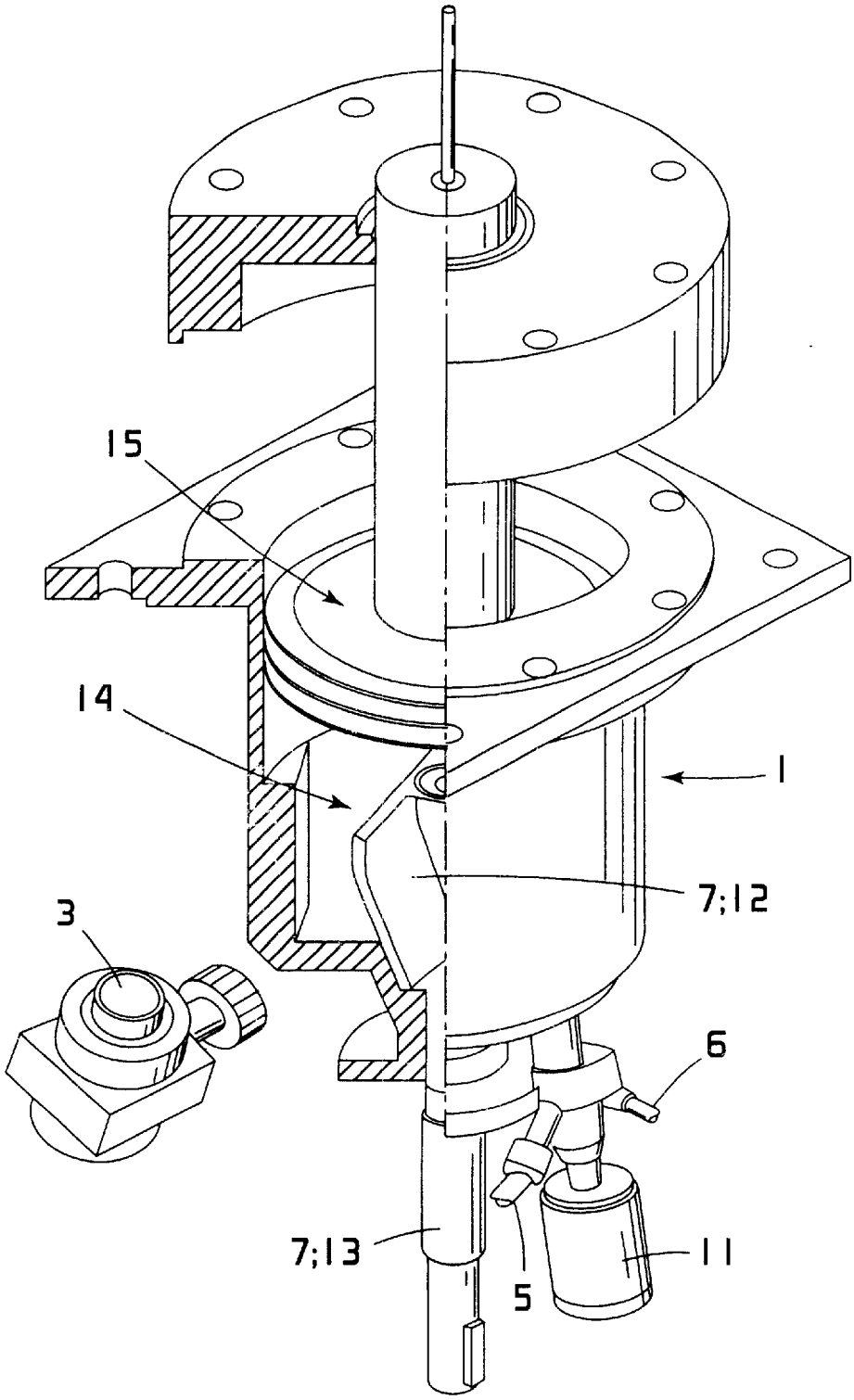
FIG. 2 presents a diagram of another mixer used in the apparatus of the invention.
Figure 3A:
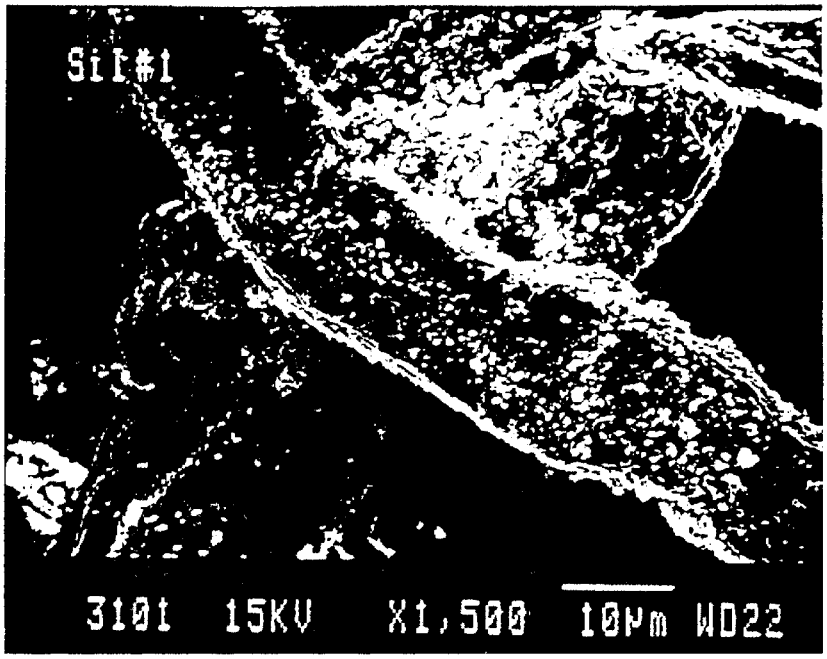
FIGS. 3*a*–3*c* present magnified electron microscope pictures of individual fibres in a fibre suspension treated by the procedure of the invention after calcium carbonate precipitation.
Figure 3B:
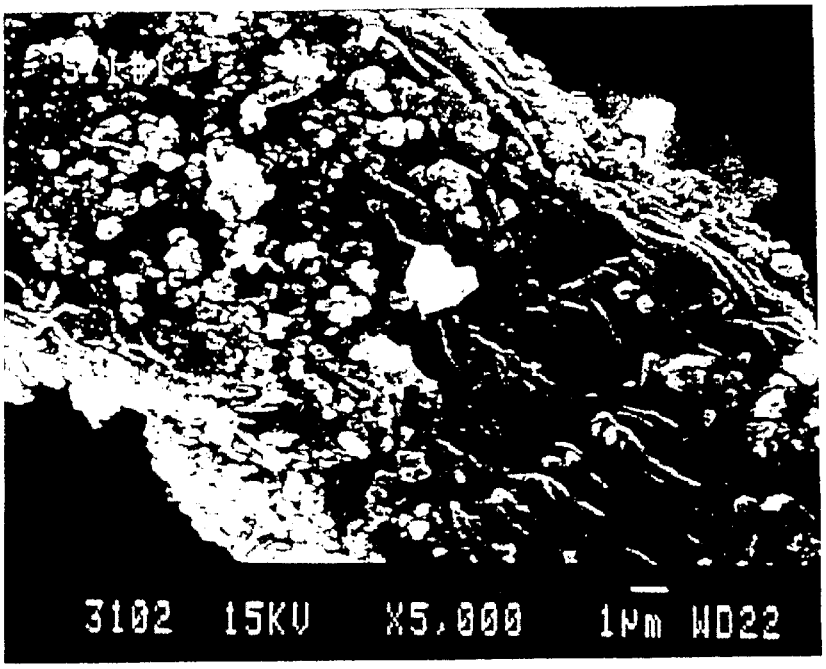
Figure 3C:
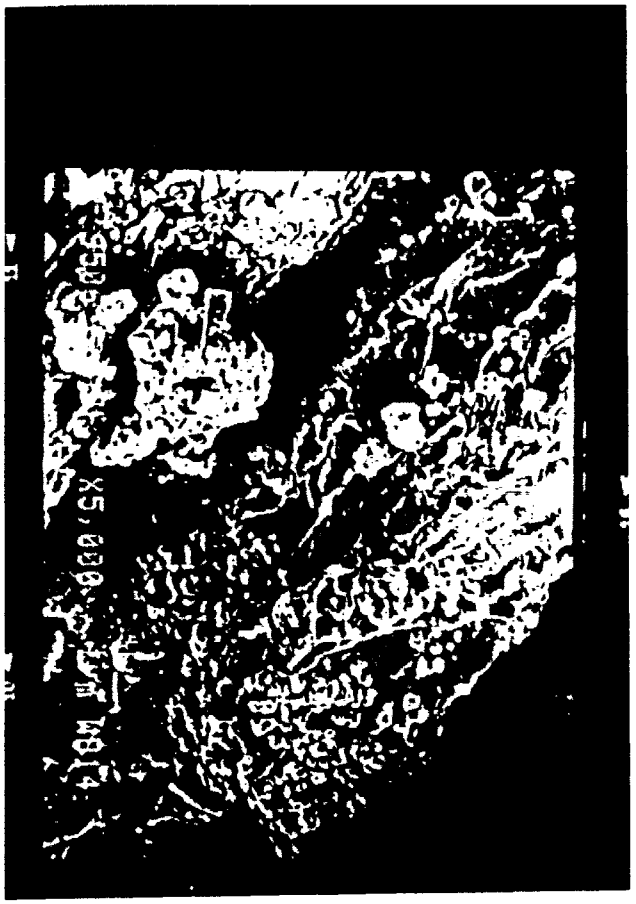

FIG. 2 shows a partly sectioned view of a mixer reactor 1 belonging to another apparatus designed for implementing the procedure of the invention. The reactor is a turbine-type one and comprises several turbine blades 12 mounted on a shaft 13. The turbine blades are in a slightly oblique position relative to the shaft so that an under-pressure and an over-pressure will be created in the turbine casing 14 on opposite sides of the turbine blades. The upper part of the turbine casing is of a cylindrical shape and it has a special movable cylinder cover 15 that allows the cylinder volume to be adjusted to a desired size. The cover 15 is removed to allow pulp to be supplied into the mixing chamber 14, whereupon the cover is mounted again. The cover 15 may be provided e.g. with a hydraulic actuator for moving the cover and then adjusting the volume and pressure of the chamber 14. The apparatus is provided with a sampling valve 11 for the taking of samples, an outlet duct 3 for removal of the pulp from the mixing chamber, a feed device 5 for adding a raw material, e.g. calcium hydroxide into the pulp, and a gas feed device 6 for adding a precipitating gas, e.g. carbon dioxide, into the mixer. The apparatus may be provided with several feed devices for the supply of different chemicals, chemicals to be precipitated as well as precipitating chemicals and additives, into the reactor. In addition, the apparatus can be provided e.g. with a control device such as a computer, as shown in FIG. 1, for control of the apparatus and calculation of results.

Example 1

Pore filling of cellulose fibres by precipitating calcium carbonate (in-situ) into the pores in the walls of cellulose fibres in a fibre suspension.

The experiment was carried out using an apparatus as presented in FIG. 2. The total volume of the mixing chamber of the mixer was 2.5 l, and the mixing motor had a power of 5.5 kW, 3000 rpm.

In the experiment, chemical birchwood pulp at a consistency of 10 w-% and a stoichiometric amount of calcium hydroxide were proportioned into the mixer. The pH of the mixture was determined and the mixture was stirred before the precipitation reaction was started. The temperature of the mixture was adjusted to 18° C., whereafter the temperature was no longer controlled. The reaction was started by feeding 100% carbon dioxide into the mixer and the progress of the reaction was monitored by observing the carbon dioxide pressure while stirring the mixture in the fluidized state. During 25 s., an amount of carbon dioxide somewhat exceeding the stoichiometric amount required for the reaction was fed in. The mixing speed was 3000 rpm. After the mixing, the carbon dioxide, which was now very evenly distributed in the mixture, was allowed to react for 1 min without the mixture being stirred, whereupon the mixture was stirred for 2 min at a speed of 400 rpm. 4 min after the proportioning, the mixture was stirred for 20 s at 3000 rpm, and 5 min after the proportioning, extra carbon dioxide was removed from the mixer. The temperature and pH of the pulp were measured.

For the pulp thus treated, the $CaCO_3$ particle size and shape were analyzed using an electron microscope (SEM). The mineral form of the $CaCO_3$ was determined via X-ray diffraction analysis. After the outer surfaces of the fibres had been washed, ash measurements on the fibres were carried out to establish the $CaCO_3$ content inside the fibres.

In performing the precipitation in this experiment, the filler content in terms of calcium carbonate was 20 w-% for the 1. precipitation, and 30 w-% for the 2. precipitation. The consistency of the chemical pulp was 10 w-% and its total mass 100 g. The amounts of chemicals are shown in Table 1.

TABLE 1

| filler content % | $mCaCO_3$, g | | $mCa(OH)_2$, g (stoichio-metric) | $mCO_2$, g (stoichio-metric) |
|---|---|---|---|---|
| 20 | 25 | => | 18.51 | 10.99 |
| 30 | 42.86 | | 31.73 | 18.85 |

In other words, when 18.51 g of $Ca(OH)_2$ and 10.99 g of $CO_2$ were used in the reaction, 25 g of $CaCO_3$ was obtained as a result, corresponding to a filler content of 20 w-%. The $Ca(OH)_2$ used in the precipitation was of the p.a. quality.

As indicated by the mixing rector pressure readings, the reaction was completed in the 1. precipitation in about 3.5 min and in the 2. precipitation in about 5 min after the start of the reaction. This was confirmed by the pH measurements after the precipitation, when the pH-value was about 7. Thus, the reaction was very fast.

In proportion to the total amount of calcium carbonate, the reaction time needed was only about 14% of what it is at a low consistency and in normal pressure when the amount of carbon dioxide used is 15%. In other words, based on the experiments carried out, more than 7-fold precipitation of calcium carbonate was achieved.

According to the X-ray diffraction analysis, the precipitated calcium carbonate consisted of pure calcite (mainly rhombohedral, roundish). The particles distinguishable on the surface of the fibres had an average diameter of about 0.5 - $\mu$m. The calcium carbonate in the fibre wall was of a smaller crystal size. When the pore-filled fibres were incinerated, a fibre skeleton remained, which was not observed in the case of fibres without a filling. In addition, for pulp samples in which the calcium carbonate particles had been washed away from the fibre surfaces, the filler content was about 10 w-%. These facts indicated that the calcium carbonate was inside the fibre wall.

FIGS. 3*a*–3*d* present pictures taken with an electron microscope, showing fibres after calcium carbonate precipitation. From the pictures it can be seen that the size of the calcium carbonate particles on the surface of the fibres is excellent in regard of the optical properties of paper. Although some of the particles are on the surfaces of the fibres, it can be utilized like a commercial filler added in the conventional manner between fibres. The retention agents used may also be conventional.

Example 2

Paper properties when chemical pulp fibres pore-filled at medium consistency are used.

For sheet tests, pore-filled pulp taken from precipitation 2 of example 1 was used, so the pulp had a calcium carbonate content of 30 w-% after precipitation. Sheets of 60 g/m$^2$ were produced in a laboratory sheet mould. The retention agents used were cationic starch, 0.8 w-%, and silicic acid BMA, 0.25 w-% of the mass of the paper. The amount of calcium carbonate in the fibre walls in the paper was regulated by altering the amount of pore-filled fibres as indicated by Table 2 below.

TABLE 2

| No. of sheet series | Long fibre | pore-filled birchwood fibre | birchwood fibre | target filler content in sheet |
|---|---|---|---|---|
| 1. | 40% | 12% | 48% | ~3.6% |
| 2. | 40% | 24% | 36% | ~7.2% |
| 3. | 40% | 36% | 24% | ~10.8% |
| 4. | 40% | 48% | 12% | ~14.4% |
| 5. | 40% | 0% | 60% | 0% |
| 6. | 40% | 0% | 60% | 9% Albafil M PCC |
| 7. | 40% | 0% | 60% | ~18% Albafil M PCC |

Sheet series 5–7 were control samples.

Table 3 presents the paper properties of paper samples produced using fibres treated by the method of the invention and commercial calcium carbonate (Albafil M, Specialty Minerals), respectively, as raw material of the paper; the pore-filled fibres were not washed externally after precipitation, which is important with a view to water economy and process solutions in practical applications.

TABLE 3

| | 1 | 2 | 3 | 4 | 5 | 6 | 7 |
|---|---|---|---|---|---|---|---|
| filler content, % | 2.9 | 6.2 | 9.1 | 12.5 | 0 | 5.8 | 12.9 |
| density, kg/m$^3$ | 542 | 534 | 535 | 526 | 580 | 570 | 565 |
| ISO lightness, % | 85.4 | 85.7 | 86.0 | 86.8 | 84.6 | 85.4 | 87.2 |
| flexural strength, mNm | 0.188 | 0.188 | 0.186 | 0.176 | 0.183 | 0.188 | 0.166 |
| tensile strength, Nm/g | 32.7 | 30.0 | 29.7 | 26.0 | 33.1 | 32.3 | 25.8 |

Figure 4A:
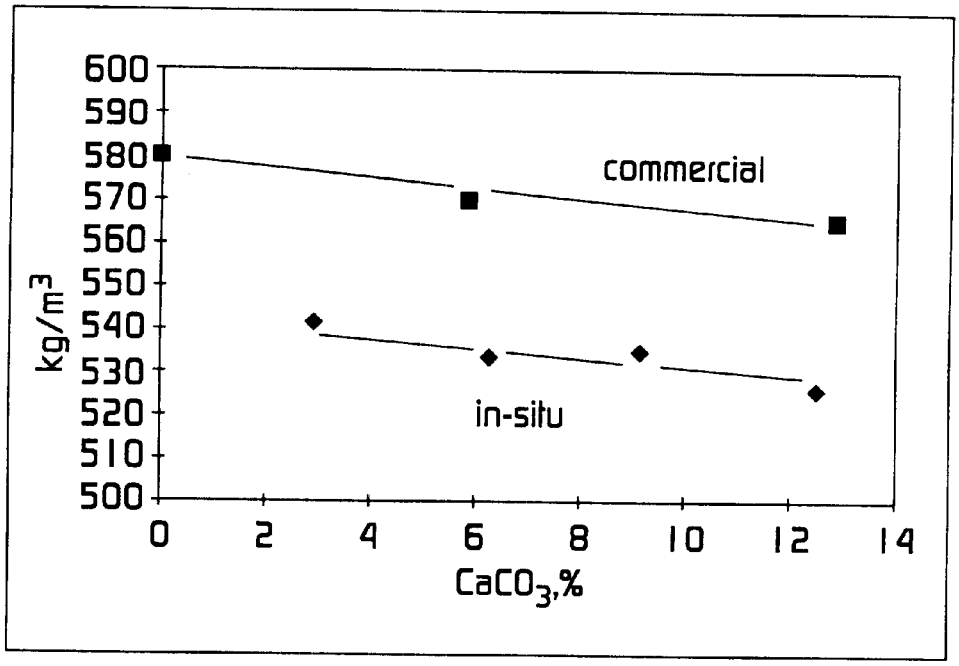
FIGS. 4*a*–4*d* represent the density, ISO lightness, flexural strength and tensile strength of paper produced using pulps processed by the procedure of the invention, in comparison with pulps in which commercial calcium carbonate fillers have been added in the conventional manner.
Figure 4B:
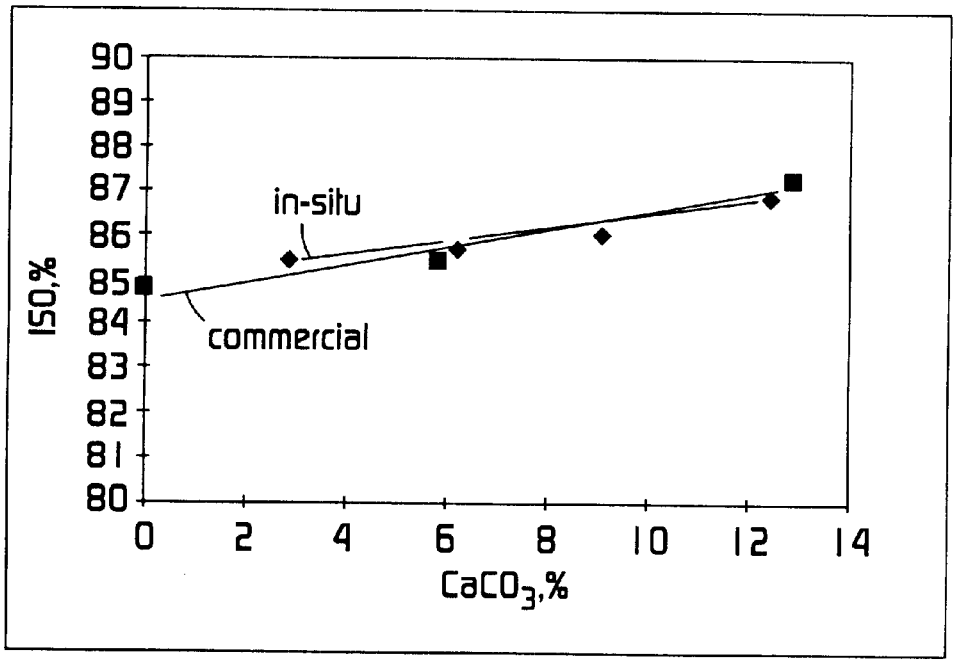
Figure 4C:
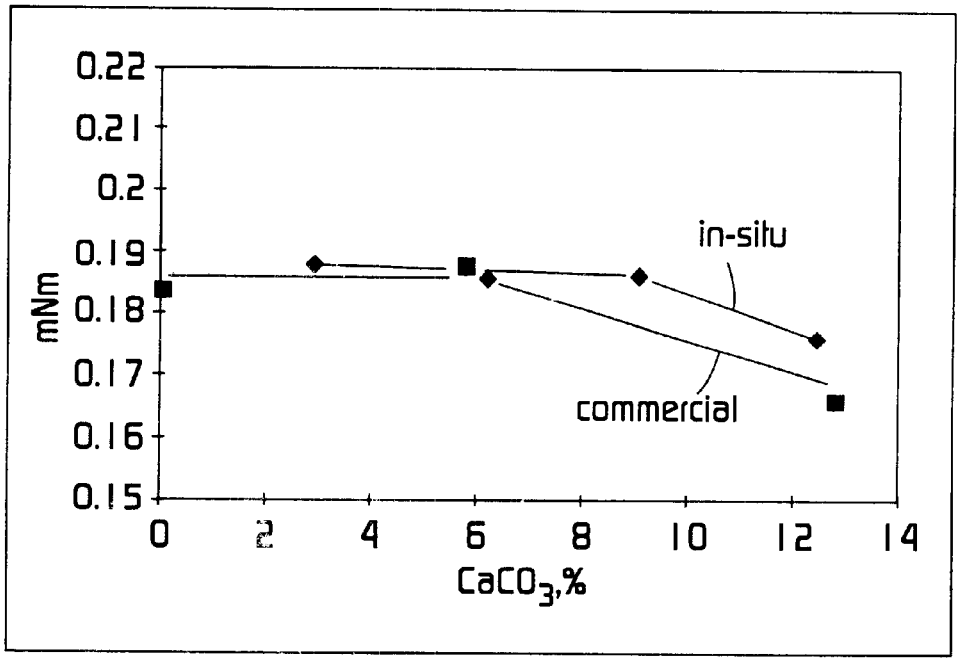
Figure 4D:
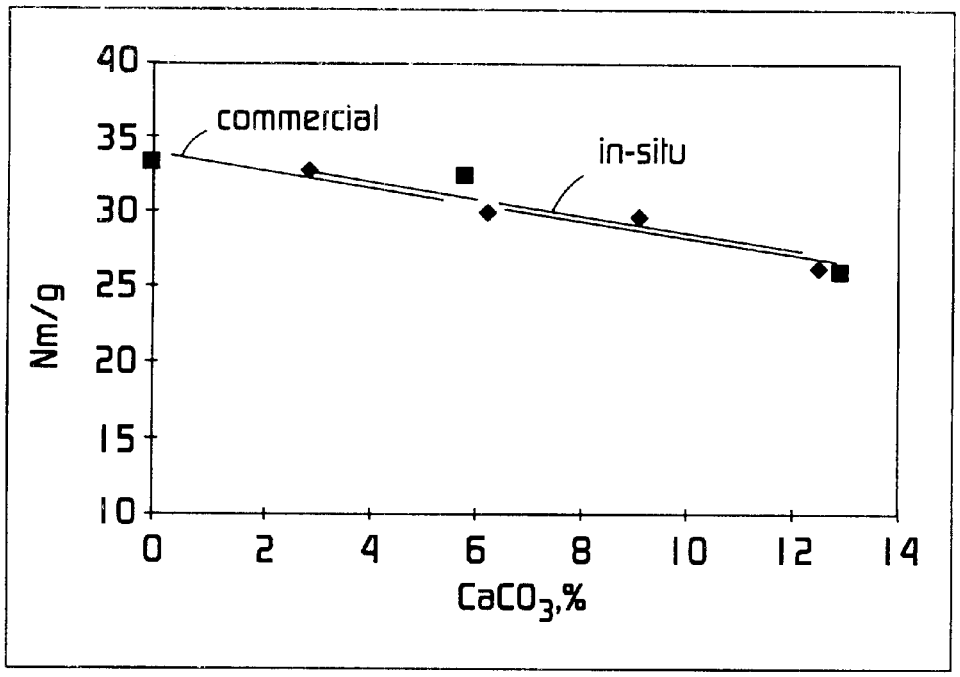

The results are also shown in a graphic form in FIGS. 4*a*–4*c*.

As a raw material for paper, fibres pore-filled at medium consistency according to the procedure of the invention gave a clearly lower paper density than untreated fibres together with commercial calcium carbonate (Albafil M, Specialty Minerals), and the lightness and tensile strength of the paper were at the same level. Due to a lower density of the paper, its flexural strength was also clearly better when fibres treated according to the procedure of the invention were used as raw material. The tensile strength was clearly higher as compared with prior-art precipitation methods. It is to be noted that the fibres used in this example were not washed at all after the precipitation stage, and still the tensile strength was at the same level as for paper produced using untreated fibres together with commercial calcium carbonate. The good tensile strength value is most probably due to the fact that the amount of bulk water in medium-consistency pulp is considerably smaller than in low-consistency pulp, which means that less calcium carbonate is precipitated in the bulk solution during the precipitation process and therefore less calcium carbonate adheres to the fibre surfaces.

The result achieved in very good. —A lower paper density and a higher flexural strength further contribute towards reducing the grammage of paper.

According to the embodiment examples, the precipitation procedure of the invention is superior in respect of paper properties as compared with earlier precipitation methods.

The embodiment examples are intended to illustrate the invention without limiting it in any way.

We claim:

1. Method for adding a filler into a pulp based on cellulose fibers, comprising:

fluidizing the pulp;

adding calcium hydroxide to the fluidized pulp to form a mixture; and adding carbon dioxide while stirring the mixture in fluidized state for precipitating calcium carbonate as the filler in pores and lumens of the fibers.

2. Method as defined in claim 1, further comprising stirring the pulp in fluidized state while adding calcium hydroxide.

3. Method as defined in claim 1, further comprising adding filler while the pulp is at a medium consistency.

4. Method as defined in claim 3, further comprising adding filler while the consistency of the pulp is 5–18 w-%.

5. Method as defined in claim 1, further comprising adding carbon dioxide at a pressure of 1–20 bar.

6. Method as defined in claim 1, wherein the mass ratio of calcium hydroxide and cellulose fibers during precipitation if 0.01–2.

7. Method as defined in claim 1, further comprising maintaining a precipitation temperature at 5–150° C.

8. Method as defined in claim 7, further comprising maintaining the precipitation temperature at 10–90° C.

9. Method as recited in claim 1, further comprising adding the filler while the consistency of the pulp is 5–18 w-% and comprising adding carbon dioxide at a pressure of 1–20 bar.

10. Method for adding a filler into a pulp based on cellulose fibers, comprising:

fluidizing the pulp;

adding calcium hydroxide to the fluidized pulp to form a mixture; and adding a stoichiometric amount of carbon dioxide required for reaction at a pressure of 1–20 bar while stirring the mixture in fluidized state for precipitating calcium carbonate as the filler in pores and lumens of the fibers, wherein a mass ratio of calcium hydroxide and cellulose fibers during precipitation is 0.1–0.3 and a precipitation temperature is 10–90° C., and wherein a consistency of the pulp is 5–18 w-% when adding calcium hydroxide and carbon dioxide.

11. Method for producing porous calcium carbonate aggregates to be used in paper manufacture, comprising:

fluidizing cellulose-fiber based fine material;

adding calcium hydroxide to the fluidized cellulose-fiber based fine material to form a mixture; and adding a stoichiometric amount of carbon dioxide required for reaction at a pressure of 1–20 bar while stirring the mixture in fluidized state for precipitating calcium carbonate in pores and lumens of the fine material, wherein a mass ratio of calcium hydroxide and fine material during precipitation is 0.14–0.4 and a precipitation temperature is 10–90° C., and wherein a consistency of the pulp is 5–18 w-% when adding calcium hydroxide and carbon dioxide.

* * * * *